United States Patent [19]

Evans

[11] Patent Number: 4,597,842

[45] Date of Patent: Jul. 1, 1986

[54] METAL RECOVERY PROCESS

[75] Inventor: Joseph P. Evans, Chelmsford, England

[73] Assignee: Porters Grove Metal Recovery Co., Inc., Bridgeport, Conn.

[21] Appl. No.: 711,644

[22] PCT Filed: Jan. 16, 1985

[86] PCT No.: PCT/US85/00063

§ 371 Date: Feb. 19, 1985

§ 102(e) Date: Feb. 19, 1985

[87] PCT Pub. No.: WO85/03955

PCT Pub. Date: Sep. 12, 1985

[51] Int. Cl.[4] ..... C25F 5/00

[52] U.S. Cl. ..... 204/130; 204/106; 204/108; 204/112; 204/114; 204/275

[58] Field of Search ..... 204/106–108, 204/112–113, 114–117, 119, 130, 275

[56] References Cited

U.S. PATENT DOCUMENTS 1,462,421 7/1923 Pearson et al. ..... 204/130

4,004,994 1/1977 Andrus ..... 204/130

*Primary Examiner*—R. L. Andrews

*Attorney, Agent, or Firm*—Costas, Montgomery & Dorman

[57] ABSTRACT

An electrolytic metal recovery process and apparatus for removing metal from a low metal content solution utilizing a recovery cell where a bed of metal is disposed on a perforate member above the floor of the cell and the cathodes of the cell extend into the bed to provide an essentially infinite area cathode through which the solution treated filters prior to removal from the cell.

18 Claims, 4 Drawing Figures

METAL RECOVERY PROCESS

FIELD OF THE INVENTION

This invention relates to electrolytic recovery of metals from solution and, more particularly, relates to apparatus and a method which will obtain almost complete recovery of a metal from solution in powdered form, leaving less than one part per million of the metal in the finally treated solution.

BACKGROUND OF THE INVENTION

Electrolytic recovery of metals from solution is well known. Such electrolytic recovery is disclosed in U.S. Pat. Nos. 3,785,950; 3,535,218; 1,839,905; and 3,579,431.

The present invention is particularly suited for the removal of metals from solution of low metal content where the metal will deposit on a cathode in a powdery form. An example of this is the removal of copper from etching solutions used on printed circuit boards and the invention will be described in that environment. In the etching of printed circuit boards using one common etchant, copper is introduced in the etchant and cupric or cuprous ammonium chloride is produced. Copper can be efficiently recovered from this used etchant solution and also etchants which contain concentrations of cupric or cuprous ammonium salts. By removing the copper electrolytically, the etching solution can be substantially regenerated. However, the processed etchant still contains some copper in solution and the solution may be objectionable as an etchant. In one copper recovery technique, a cell containing a plurality of alternate anodes and cathOdes is utilized where the electrolyte is ammoniacal ammonium chloride. The anodes are made of graphite and the cathodes of copper. Oxygen is liberated at the anode and the following effective reaction occurs at the cathode.

$$Cu(NH_3)_4\,Cl_2 + H_2 = Cu + 2NH_4\,Cl + 2NH_3$$

The outflowing solution, therefore, becomes a regenerated etchant, but, however, still contains some copper in solution.

In the described recovery process, copper is deposited in powdery form on the cathode due to the electrolysis occurring within the cell and the outflowing solution becomes a regenerated printed circuit board etchant of substantially reduced copper content. The copper powder builds up on the cathodes, and occasionally, the adhered powder falls to the bottom of the cell. The copper powder collected in the bottom of the cell is occasionally removed by pumping, or any other conventional method. A system of the type described will provide an electrolyte output containing approximately two grams/litre copper while the etchant introduced into the cell to be treated contains about one hundred and twenty grams per litre.

The present invention provides a system for secondary treatment of the etchant which will remove additional copper in powdered form and provide a clarified etchant having less than one part per million copper. The finally treated etchant, after $NH_3$ addition, is essentially equivalent to a virgin etchant.

The metal content of a solution may be reduced by primary treatment using other techniques such as ion exchange, hydrogen reduction and solvent extraction, as well as electrolysis.

SUMMARY OF THE INVENTION

The invention provides a treatment system which may receive the effluent output of a primary treatment system as described above. In fact, the secondary treatment cell may receive as inputs the output of several primary treatment cells, or it may receive previously treated etchant from a reservoir.

The secondary treatment cell comprises the provision of alternate anodes and cathodes where the cathodes extend below the anodes into a bed of powdered copper or other metal to be removed from solution. The bed of powdered copper is supported above the bottom of the cell on a perforate plate covered by a filter cloth. This arrangement provides a cathode of essentially infinite area through which the treated etchant must filter prior to removal from the system. This additional treatment effectively removes all copper from the treated etchant and provides an etchant of essentially virgin properties for reuse.

An object of this invention is to provide a new and improved method and apparatus for removing metal from solution of low metal content, and providing a clarified essentially metal free solution.

The features of the invention which are believed to be novel are particularly pointed out and distinctly claimed in the concluding portion of this specification. The invention, however, both as to its operation and organization together witn further objects and advantages thereof, may best be appreciated by reference to the following detailed description taken in conjunction with the drawings.

DETAILED DESCRIPTION OF THE ILLUSTRATED EMBODIMENTS

Figure 1:
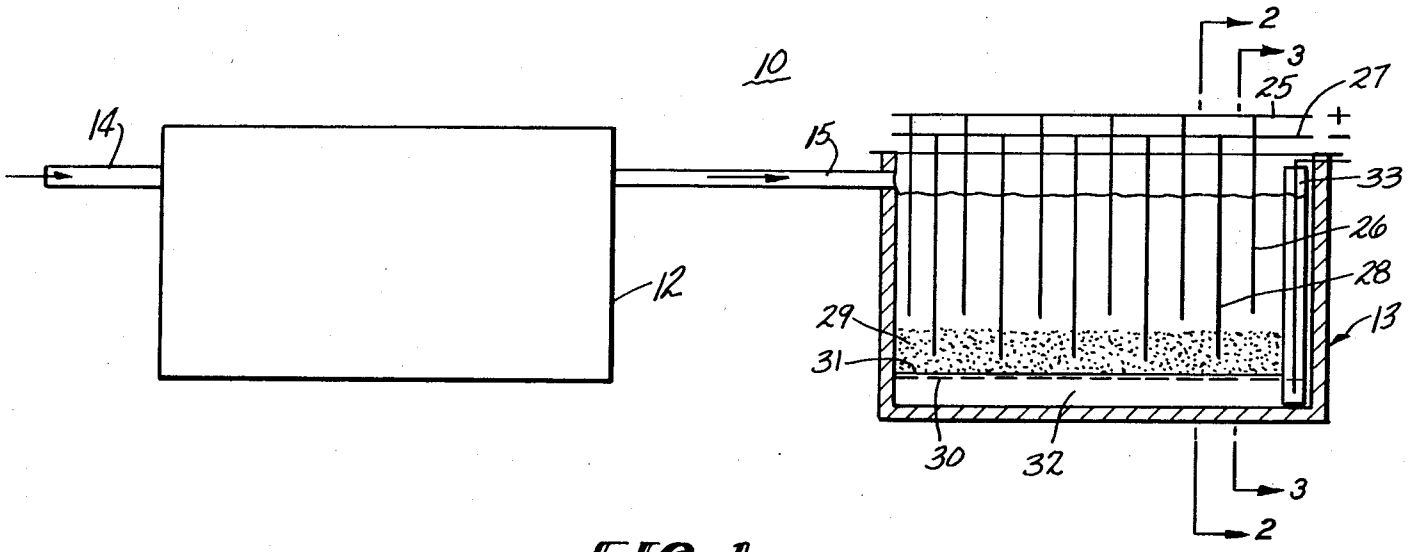
FIG. 1 is a schematic representation of a metal recovery system embodying the invention, showing primary and secondary treatment cells.

A system in which the invention may be embodied is shown in schematic side elevation in FIG. 1. This system 10 comprises a primary treatment cell 12 and a secondary treatment cell 13. The cell 12 comprises a container having side, end and bottom walls. Cell 12 may contain a plurality of alternate anodes and cathodes (not shown) as hereinafter exemplified in cell 13.

The inside of the walls of the cell are coated with electrical insulating material such as polypropylene. The effluent to be treated, which for purposes of this example may be considered cupric ammonium chloride, is introduced to cell 12 through a conduit 14 and exits cell 12 through a conduit 15 to secondary cell 13. Cell 12 is merely representative of any cell or system which will reduce a copper rich etching solution to about two grams/litre. The etchant is usually considered spent when it reaches one hundred thirty grams/litre.

Under electrolysis, copper is deposited at the cathodes as finally divided, loosely adhered, copper powder. Periodically, copper powder which falls to the bottom of cell 12, is pumped out, filtered and washed.

Cell 12 operates continuously and regenerated etchant outflows continuously from primary cell 12.

Secondary cell 13 receives the primary processed overflow from primary cell 12 via conduit 15. The secondary cell, in practice, may receive the primary treated etchant from several primary cells. The secondary cell may receive the etchant from other sources than primary cell 12, such as a storage reservoir for primary treated etchant. The primary treatment may be done at a remote location. It is not necessary that the etchant receive primary treatment if the etchant has a low metal concentration of about two grams/litre.

The present invention is applicable to clarification of solutions having a low metal content regardless of whether or not the solution received primary treatment.

The primary treated etchant is continuously conveyed to secondary treatment cell 13 from primary cell 12 via conduit 15. Secondary cell 13 comprises a vessel with the inside walls electrically insulated as by means of a coating of polypropylene. A positive bus 25 is electrically connected to a plurality of anodes 26 depending into secondary cell 13 and a negative bus 27 is electrically connected to a plurality of cathodes 28 which extend below the free end of the anodes 26 into a bed 29 of powdered copper.

The bed of powdered copper is supported on a perforate plate 30 which is covered with a filter cloth 31. The perforate plate 30 is also electrically insulated as by coatings of polypropylene on either side. The perforate plate 30 is supported above the bottom wall of cell 12 by means hereinafter described and defines therewith a reservoir or collecting chamber 32.

A standpipe 33 of insulating material is in communication with reservoir 32. Plate 30 is cut out to permit standpipe 33 to extend therethrough.

Figure 2:
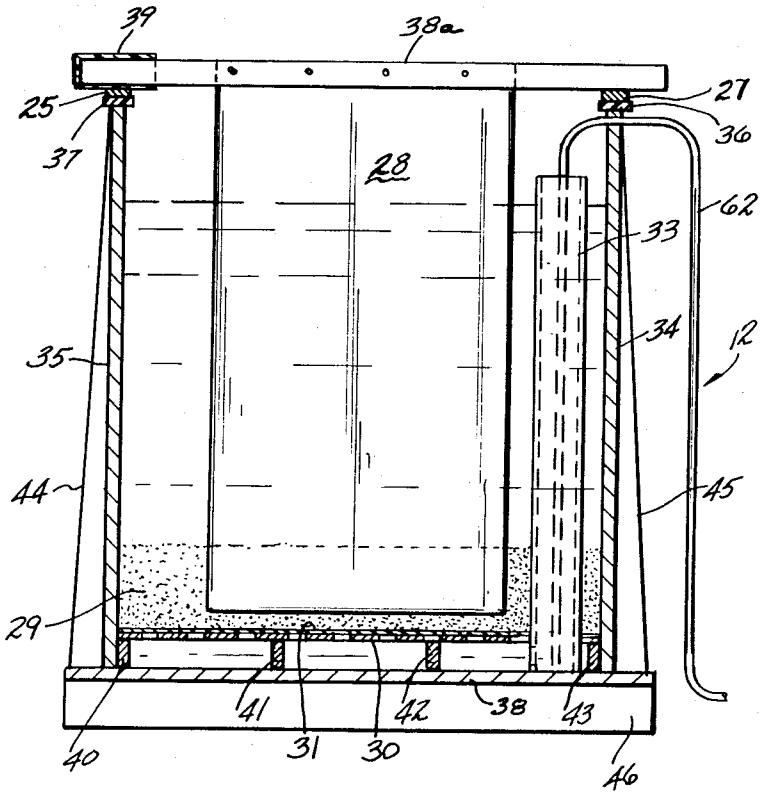
FIG. 2 is a sectional view of the secondary cell of FIG. 1 as seen in the plane of lines 2—2 of FIG. 1.

Reference is now made to FIG. 2 which is a section through secondary cell 12 showing a cathode 28. Secondary cell 13 has upstanding sidewalls 34 and 35 extending from a bottom wall 38. The busses 25 and 27 are supported on insulating strips 36 and 37, respectively, which are affixed to the upper edges of sidewalls 34 and 35. An electrode carrier 38*a* supports a cathode 28 as hereinafter described. One end of carrier 38*a* receives an insulating sleeve 39. Thus the cathode carriers 38*a*, which are electrically conductive, are electrically connected to negative bus 27 but electrically insulated from positive bus 25.

The cathodes 28 extend into bed 29 to a position proximate to perforate plate 30 and filter cloth 31.

The perforate plate 30 is supported above the bottom wall 31 on a plurality of support and spacing members 40, 41, 42, and 43, which extend substantially perpendicular to planes of the electrodes. Members 41 and 42 are apertured, as hereinafter described, to permit the liquid in reservoir 32 to move to standpipe 33. Sidewall stiffening members 44 and 45, and bottom wall stiffening member 46 are provided as necessary.

Figure 3:
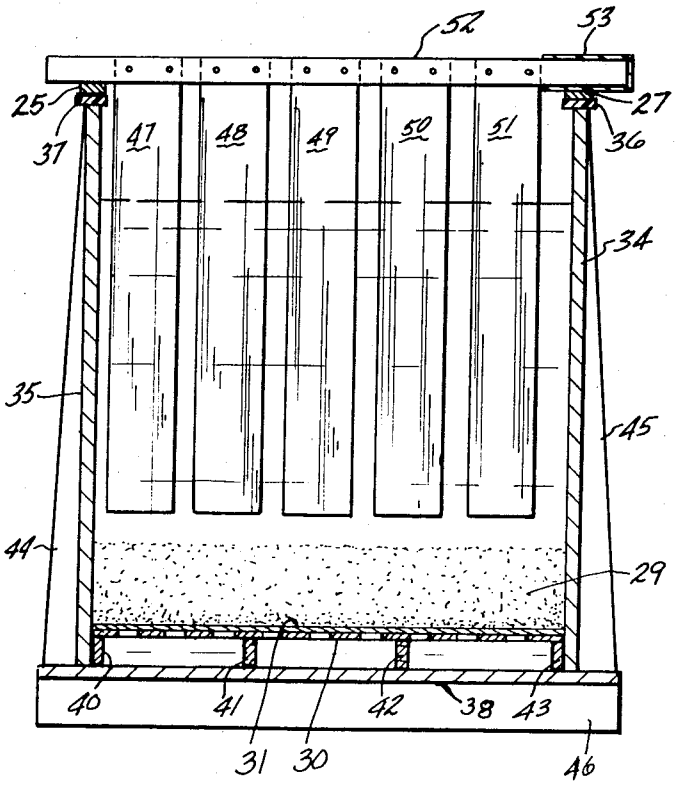
FIG. 3 is a sectional view of the secondary cell of FIG. 1, as seen in the plane of lines 3—3 of FIG. 1.

As shown in FIG. 3, each anode 26 comprises a plurality of conducting members 47–51 depending from a carrier 52. Carrier 52 is a conducting member such as copper having an insulating sleeve 53 thereon which rests on negative bus 27. The carriers for the anodes are therefore in electrical contact with positive bus 25 and insulated from negative bus 27. For simplicity of illustration, standpipe 33 is not shown in FIG. 3.

Figure 4:
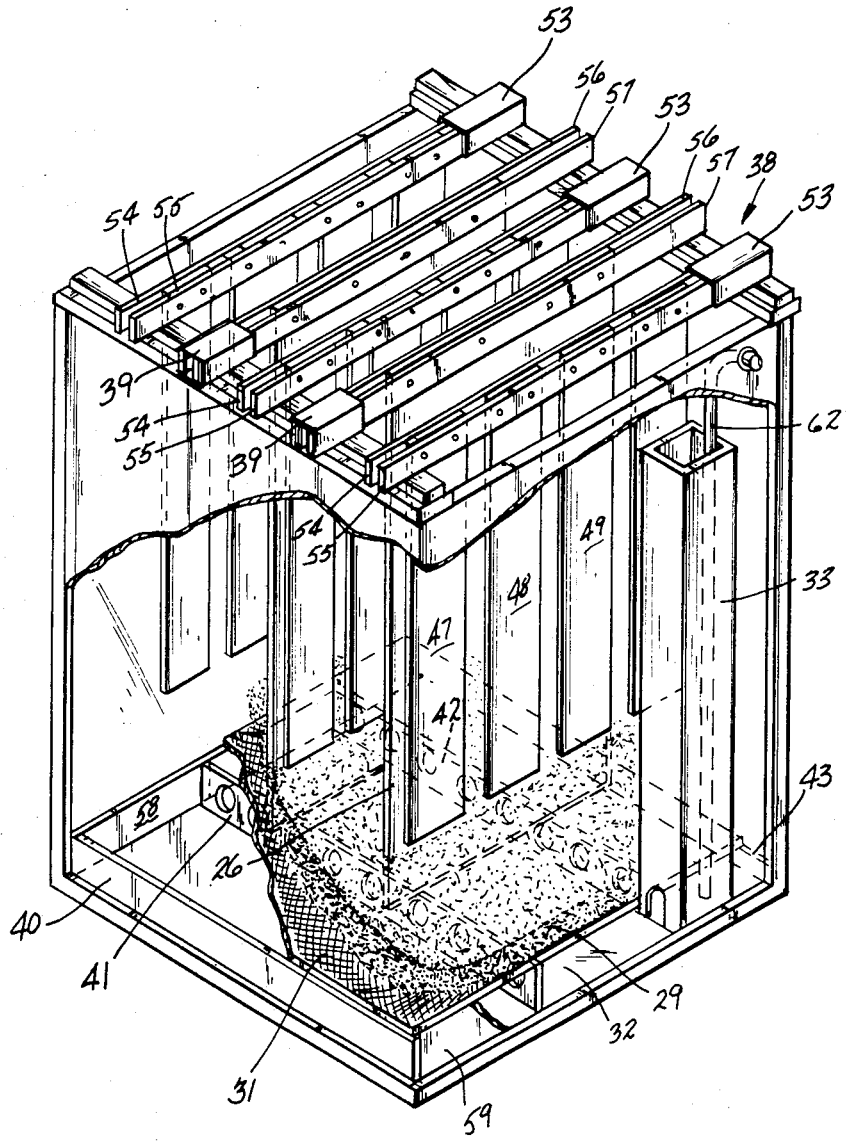
FIG. 4 is a partial isometric view, partially cut away, of the secondary cell of FIG. 1.

Reference is now made to FIG. 4 which shows a cell having only three anodes and two cathodes, for simplicity of illustration. Each of the anode carriers 52 comprises spaced apart conductive rods 54 and 55 which hold an anode 26 therebetween and support the depending anode in the cell. Each of the cathode carriers 38*a* comprises spaced apart conductive rods 56 and 57 which hold the cathodes 28 therebetween while the cathodes depend into the cell and into the cathodic bed 29. As shown in FIG. 4, the support members 40–43 for the perforate plate 30 extend substantially perpendicular to the planes of the electrodes. The supporting members 41 and 42 are apertured to permit flow of the treated fluid therethrough. Additional plate support elements 58 and 59 are provided at either end of the cell 12 to form a box-like support structure for plate 30. A conduit 62 extends downwardly into standpipe 33 and outwardly through wall 34 to permit siphoning or pumping of the solution which has filtered through the cathodic bed 29.

The provision of the cathodic bed 29 of powdered metal with the cathodes extending in thereto provides a cathode of essentially infinite area and is effective to decrease the metal in the solution treated in the secondary cell to less than one part per million. This results, in the case of treatment of printed circuit board etchants, of an essentially copperless etchant, which is suitable for reuse.

The invention has been practiced utilizing a secondary cell 13 in a size of four by four feet by five feet deep, which receives the output of four primary cells ten by four feet by five feet deep.

In the treatment of the printed circuit board etchant, the anodes are carbon and the cathodes are copper. A spacing of three inches is provided between the electrodes in both cells.

Cell 13 is operated at a current density of approximately one ampere per square foot on a clean cathode. The voltage is two and one-half to three and one-half volts. Low current density is utilized in the cell 13 because of the low concentration of metal in solution. The concentration of copper in cell 13 above bed 29 is about fifty parts/million.

The cathodes above the bed in the secondary treatment cell reduce the copper content of the solution to about 50 to 100 parts/million. The cathodic bed reduces the copper content of the solution to less than 1 part/million. It can be envisioned that these operations could take place in separated stages, i.e., secondary and tertiary, the secondary stage to consist of hanging anodes and cathodes and the tertiary stage to consist of anodes and a cathodic bed of copper powder.

If a solution, which needs to be demetalized contains about or less than 100 parts/million of metal which will deposit as a powder, then this solution could be introduced directly to the equivalent of a tertiary stage consisting of anodes and a cathodic bed of the metal powder.

The cathodic bed 29 in secondary cell 12 is initially established at a depth of about six inches and the cathode elements 28 are dimensioned to extend almost to the perforate plate 30. When the copper bed 29 builds up close to the anodes, copper is pumped from the bed 29 to leave a bed depth of approximately six inches.

In operation, the primary cells 12 are set in view of the flow rate and concentration of metal in the electrolyte to remove a predetermined amount of metal per day. The current densities of the primary and secondary cells are selected in view of the metallic content of the etchant to be treated. The current density may be varied as the concentration of metal in solution varies.

While the invention has been described in conjunction with removal of copper from printed circuit board etchant of cupric ammonium chloride of a two gram/-litre copper content, it may be utilized to remove any metal from solution where the metal content is relatively low and the metal may be deposited on a cathode in a powdered form, as for example nickel and cadmium.

Where the etchant is acidic, such as a copper sulfate, lead anodes will be used. The concentration of copper in solution outflowing cell 12 is preferably maintained at two grams/litre or less.

It may thus be seen that the objects of the invention set forth, as well as those made apparent from the foregoing description, are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A method of removing metal from a solution having a relatively low metal content comprising the steps of providing a cell having side walls and a bottom wall and alternate anodes and cathodes depending thereinto, said cathodes depending below the anodes, establishing a bed of powdered metal on a perforate member above the bottom wall of said cell so as to establish a reservoir below said bed and permit fluid to filter through said bed, said cathodes extending into said bed, introducing a metal containing solution into said cell, electrically energizing said anodes and cathodes to produce electrolysis in said cell and establishing a cathodic potential on said bed, whereby metal deposits on said cathodes and on said bed, and removing solution from said reservoir.

2. The method of claim 1 wherein the solution treated is cupric or cuprous ammonium chloride, the anodes are carbon and the cathodes are copper.

3. The method of claim 1 wherein the solution treated is copper sulphate, the anodes are lead and the cathodes are copper.

4. The method of claim 1 wherein the solution contains cadmium.

5. The method of claim 1 wherein the solution contains nickel.

6. The method of claim 1 where the metal of said bed is the same as that in the solution.

7. A method for removing metal from solution by electrolysis, which comprises the steps of providing a primary cell which will remove metal from solution and provide a solution of relatively low metal content, introducing a metal containing solution into said primary cell, providing a secondary cell having side walls and a bottom wall, and having alternate anodes and cathodes extending thereinto, said cathodes extending below said anodes, providing a perforate member above said bottom wall to define a reservoir between said perforate member and bottom wall, establishing a bed of metal on said plate in contact with the cathodes of said secondary cell, directing treated solution from said primary cell to said secondary cell, electrically energizing said anodes and cathodes of said secondary cell to produce electrolysis in said secondary cell, extracting solution from said reservoir, and periodically removing metal from said cells.

8. The method of claim 7 wherein the solution treated is cupric or cuprous ammonium chloride, the anodes are carbon and the cathodes are copper.

9. The method of claim 7 wherein the solution treated is copper sulphate, the anodes are lead and the cathodes are copper.

10. The method of claim 7 wherein the solution contains cadmium.

11. The method of claim 7 wherein the solution contains nickel.

12. The method of claim 7 where the metal of said bed is the same as that in the solution.

13. A cell for removing metal from solution by electrolysis, where the concentration of metal in solution is relatively low, said cell having side walls and a bottom wall, a plurality of alternate anodes and cathodes depending into said cell, a perforate floor in said cell above said bottom wall and defining a reservoir, a bed of powdered metal on said floor, said powdered metal being the same as that to be removed from solution, said cathodes extending below said anodes into said bed, and means for removing solution from said reservoir.

14. A method of removing metal from a solution having a relatively low metal content comprising the steps of providing a cell having side walls and a bottom wall and alternate anodes and cathodes depending thereinto, said cathodes depending below the anodes, establishing a bed of powdered metal on a perforate member above the bottom wall of said cell so as to establish a reservoir below said bed and permit fluid to filter through said bed, the metal of said bed being the same as the metal to be removed from solution, said cathodes extending into said bed, introducing a metal containing solution into said cell, electrically energizing said anodes and cathodes to produce electrolysis in said cell and establishing a cathodic potential on said bed, whereby metal deposits on said cathodes and on said bed, and removing solution from said reservoir.

15. The method of claim 14 wherein the solution treated is cupric or cuprous ammonium chloride, the anodes are carbon and the cathodes are copper.

16. The method of claim 14 wherein the solution treated is copper sulphate, the anodes are lead and the cathodes are copper.

17. The method of claim 14 wherein the solution contains cadmium.

18. The method of claim 14 wherein the solution contains nickel.

* * * * *